United States Patent [19]

Perrissoud

[11] Patent Number: 4,910,888

[45] Date of Patent: Mar. 27, 1990

[54] ALPINE SKI BOOT HAVING AN UPPER JOURNALLED ON A SHELL BASE

[75] Inventor: Claude Perrissoud, Saint-Jorioz, France

[73] Assignee: Salomon S.A., Annecy, France

[21] Appl. No.: 239,658

[22] Filed: Sep. 2, 1988

[30] Foreign Application Priority Data

Sep. 4, 1987 [FR] France ..... 87 12315

[51] Int. Cl.[4] ..... A43B 5/04; A43C 11/00

[52] U.S. Cl. ..... 36/117; 36/50; 36/121

[58] Field of Search ..... 36/117–121, 36/50, 54, 105

[56] References Cited

U.S. PATENT DOCUMENTS

| | | | |
|---|---|---|---|
| 3,793,749 | 2/1974 | Gertsch et al. . | |
| 4,060,256 | 11/1977 | Collombin et al. . | |
| 4,095,356 | 6/1978 | Robran et al. . | |
| 4,222,184 | 9/1980 | Kastinger | 36/121 |
| 4,551,933 | 11/1985 | Morell et al. . | |
| 4,575,957 | 3/1986 | Petrini | 36/121 |
| 4,602,443 | 7/1986 | Spademan . | |
| 4,624,065 | 11/1986 | Maboux et al. . | |
| 4,658,517 | 4/1987 | Miyoshi et al. | 36/117 |
| 4,677,770 | 7/1987 | De Marchi et al. . | |
| 4,759,137 | 7/1988 | Lederer . | |

FOREIGN PATENT DOCUMENTS

| | | | |
|---|---|---|---|
| 284978 | 10/1988 | European Pat. Off. | 36/117 |
| 3219772 | 1/1983 | Fed. Rep. of Germany . | |
| 3247515 | 1/1984 | Fed. Rep. of Germany | 36/117 |
| 3431468 | 3/1986 | Fed. Rep. of Germany . | |
| 2266468 | 10/1975 | France | 36/117 |

*Primary Examiner*—James Kee Chi

*Attorney, Agent, or Firm*—Sandler & Greenblum

[57] ABSTRACT

A ski boot having a shell base and an upper. The upper includes a front cuff and a rear spoiler which are independently pivoted on the shell base. The rear spoiler is mounted in such a manner as to allow two types of movement. The rear spoiler can rotate to a rearward, open position to provide a large opening for insertion of a foot. The rear spoiler can also move in a substantially vertical direction so that, when it is tightened to the front cuff, the upper can rotate as a monoblock assembly around the pivot for the front cuff.

43 Claims, 6 Drawing Sheets

ALPINE SKI BOOT HAVING AN UPPER JOURNALLED ON A SHELL BASE

BACKGROUND OF THE INVENTION

1. Field of the Invention

The present invention relates to an alpine ski boot having an upper journalled on a shell base.

2. Description of Background and Relevant Information

Alpine ski boots generally have a shell base and an upper. The upper comprises a front cuff and rear spoiler, which are tightened around the lower leg of a skier by appropriate elements. The front cuff and rear spoiler can either be journalled around a common lower transverse axis or around two independent axes.

By journalling the front cuff and rear spoiler around two independent axes, an advantageously wide opening for insertion of the foot can be obtained by pivoting the rear spoiler towards the rear of the ski boot. Despite this advantage, the journalling of the front cuff and rear spoiler on two independent axes causes a certain problem. Specifically, due to the fact that the two independent axes are fixedly mounted on the shell base and, in effect, constitute two fixed apices of a "deformable parallelogram" having movable sides formed by the front cuff and rear spoiler, there occurs, during a forward flexion of the upper, a contraction of the "parallelogram", i.e., a reduction of the distance between the front cuff and the rear spoiler. This "contraction" of the upper which accompanies the forward flexion causes a variation in the tightening around the lower leg of the skier, which is both uncontrollable and undesirable.

SUMMARY OF THE INVENTION

It is an object of the present invention to provide a ski boot which allows easy insertion of the foot and maintains the cross-sectional area of the upper when skiing.

The present invention achieves this objective by providing an alpine ski boot having an upper journalled on a shell base. The upper includes two elements adapted to surround the lower leg of a skier, which elements are individually connected to the shell base, the two elements including a front cuff pivotably mounted around a front transverse axis and a rear spoiler. Tightening means are provided for tightening the cuff and rear spoiler around the lower leg. Furthermore, linkage means are provided between the rear spoiler and the shell base adapted to allow a pivoting of the rear spoiler on the shell base around a rear transverse axis, as well as to allow a substantially vertical movement of the rear spoiler with respect to the shell base when skiing, whereby the upper pivots as an entirety around the front transverse axis of the front cuff.

Viewed in another perspective, the present invention achieves this objective by providing a ski boot comprising a shell base and an upper. The upper includes a front cuff and a rear spoiler. Means for tightening the rear spoiler to the front cuff are provided so that the upper can be tightened around the lower leg of the skier. The front cuff is pivotally mounted on the shell base, and the rear spoiler is mounted on a rear portion of the shell base. The pivotal mounting of the front cuff is effected by two projections mounted on the shell base which form a substantially horizontal, front transverse axis. The means for mounting the rear spoiler are adapted to permit both a pivotal rotation and a substantially vertical movement of the rear spoiler with respect to the rear portion of the shell base, whereby the rear spoiler is capable of rotational movement to a rearward, open position to permit insertion of a foot into the boot, and is capable of a substantially vertical movement, when the rear spoiler is tightened to the front cuff, for pivotal rotation of the tightened upper as a monoblock assembly around the axis for the front cuff.

Latching means can be provided on the upper. The latching means act in cooperation with the means for tightening to ensure rotation of the front cuff and rear spoiler as a monoblock assembly.

In one embodiment, the latching means comprise teeth or lugs formed on the front cuff and the rear spoiler. These teeth or lugs are adapted to be maintained in an engaged relationship by the tightening of the front cuff to the rear spoiler effected by the means for tightening.

In another embodiment, the latching means comprise a rear support blocking lever journalled on a substantially horizontal axis on the rear spoiler. This axis is positioned above the axes on which the front cuff and rear spoiler pivot. The rear support blocking lever includes, at a front portion, at least one hook portion, with each hook portion being adapted to engage one of the two projections which form the axis for the front cuff.

The rear support blocking lever can be in the shape of a stirrup which includes a rear, upper transverse member extending towards the rear of the rear spoiler, and two frontwardly and downwardly extending laterally inclined arms journalled on the axis on the rear spoiler. Each arm culminates in a front end portion having a hook portion adapted to engage one of the two projections which form the axis for the front cuff.

The hook portions can be composed of cut-outs which are open on the front, lower edge of each inclined arm to form a hook portion that is downwardly open, or can be composed of cut-outs which are open on the front, upper edge to be upwardly open.

Moreover, the rear support blocking lever can include spring means on the axis journalled on the rear spoiler to bias the rear support blocking lever in a direction to engage the hook portion with the projections forming the axis for the front cuff.

Retention means can be mounted on the rear spoiler for maintaining the rear support blocking lever in a latched position when skiing. The retention means can comprise a lever composed of an upper arm portion forming an upper activation handle and a lower arm portion in the shape of a hook. The lever is journalled on a substantially horizontal, transverse axis, mounted on the rear spoiler, at a location between the upper and lower arm portions. A spring means is adapted to bias the hook of the lower arm portion against the rear, upper transverse member of the rear support blocking lever to maintain the lever in a latched position when skiing.

In another embodiment of the invention, the latching means can comprise at least one lower flap. Each lower flap is composed of a portion of the rear spoiler which extends frontwardly and downwardly. Further, each lower flap has a hook-shaped portion formed by a cut-out, which hook-shaped portion is adapted to engage one of said projections forming the axis for the front cuff.

Locking means can be mounted on each lower flap to maintain each lower flap in a position engaging the projection. The locking means can comprise a housing means mounted ono the lower flap; a rod means slideably mounted within the housing means and extending out over the cut-out; a spring means biasing the rod means over the cut-out; and an activation handle for retracting the rod means into the housing means to permit removal of the lower flap from a projection.

The means for mounting the rear spoiler on a rear portion of the shell base can comprise a linkage means comprising a substantially horizontal, rear transverse axis mounted on a rear portion of the shell base; a radial transverse axis mounted on a rear transverse axis; and a seat means affixed to the rear spoiler which includes a relatively narrow, hollow inner portion in which the radial tongue is adapted to slide. The linking means can further include means for biasing the rear spoiler in either an upward or downward direction. This means for biasing can comprise a spring means.

BRIEF DESCRIPTION OF THE DRAWINGS

The invention will now be described with reference to non-limiting examples demonstrating various embodiments of the present invention, with reference to the annexed drawings, in which.

DESCRIPTION OF PREFERRED EMBODIMENTS

The present invention overcomes the above-noted disadvantageous contraction of the upper during forward flexion by virtue of a very simple linkage of the rear spoiler on the shell base.

In accordance with the present invention, the alpine ski boot includes an upper journalled on a shell base. The upper comprises a front cuff pivotably mounted around a front transverse axis and a rear spoiler, which front cuff and rear spoiler are individually connected to the shell base and surround the lower leg of the skier. Tightening means are provided for tightening the front cuff and rear spoiler around the lower leg. Additionally, linkage means are provided between the rear spoiler and the shell base so as to permit a pivoting of the rear spoiler on the shell base, around a rear transverse axis, to an open foot inserting position, as well as a substantially vertical movement of the rear spoiler with respect to the shell base, when skiing, whereby the upper pivots in its entirety as a monoblock assembly around the front transverse axis of the front cuff. In other words, the front cuff and rear spoiler are fixedly attached to each other when skiing so that they pivot as a single, integral unit around the front transverse axis without any substantial relative movement or contraction therebetween. Additionally, latching means can be provided on the ski boot to ensure that the upper pivots as a monoblock assembly when skiing.

According to one embodiment of the invention the ski boot includes movable latching means for affixing the front cuff and rear spoiler to each other when skiing, while permitting independent rotation of the rear spoiler when the latching means is open to enable insertion of the foot. Preferably, the latching means comprise a rear supported blocking lever which is journalled on the rear spoiler around a third transverse axis situated above the axes of the cuff and the spoiler. This lever has in its extreme front portion, a hook portion which can engage and latch on a projection forming the journal axis of the front cuff on the shell base.

The alpine ski boot according to the invention offers the advantage that the degree of tightening of the upper does not vary during pivoting of the upper towards the front or rear since the front cuff and the rear spoiler pivot as a monoblock assembly around the front transverse axis of the front cuff. Additionally, as with conventional ski boots having two journal axes, an advantageously wide opening of the rear spoiler towards the rear is permitted, so as to facilitate insertion of the foot.

Figure 1:
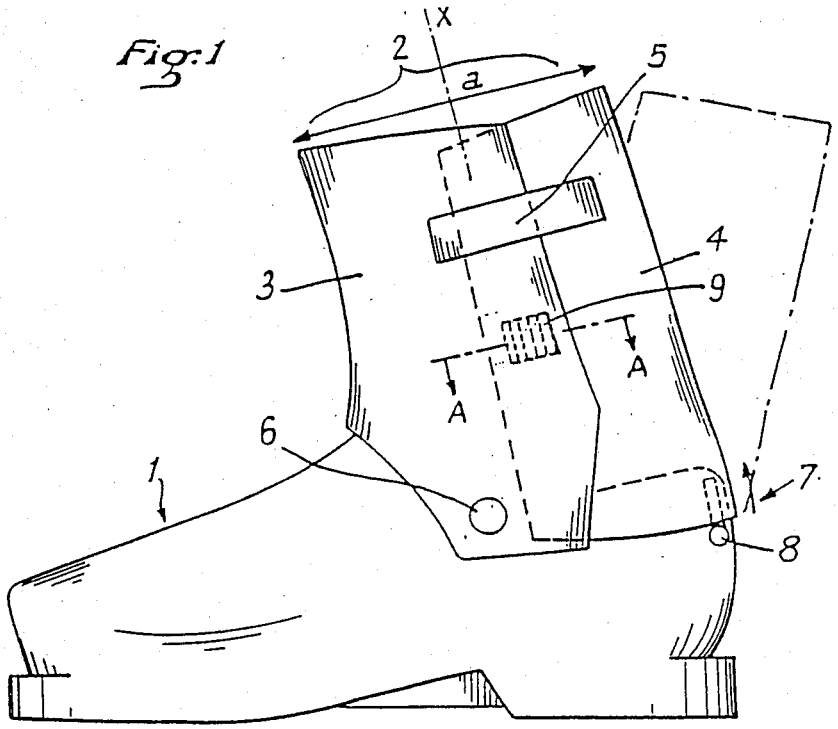
FIG. 1 illustrates an elevational view of an alpine ski boot according to the invention, in which the upper is shown tightened around the lower leg in the initial position wherein the upper is not forwardly flexed.
Figure 2:
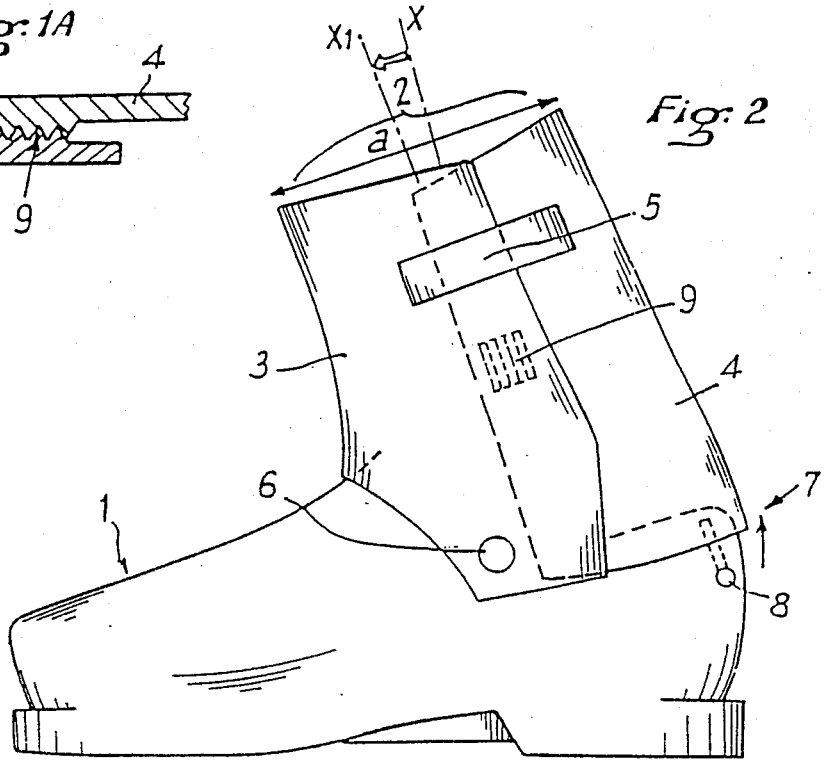
FIG. 2 illustrates an elevational view of the shoe of FIG. 1, in which the upper, still tightened around the lower leg, is shown flexed towards the front.
Figure 3:
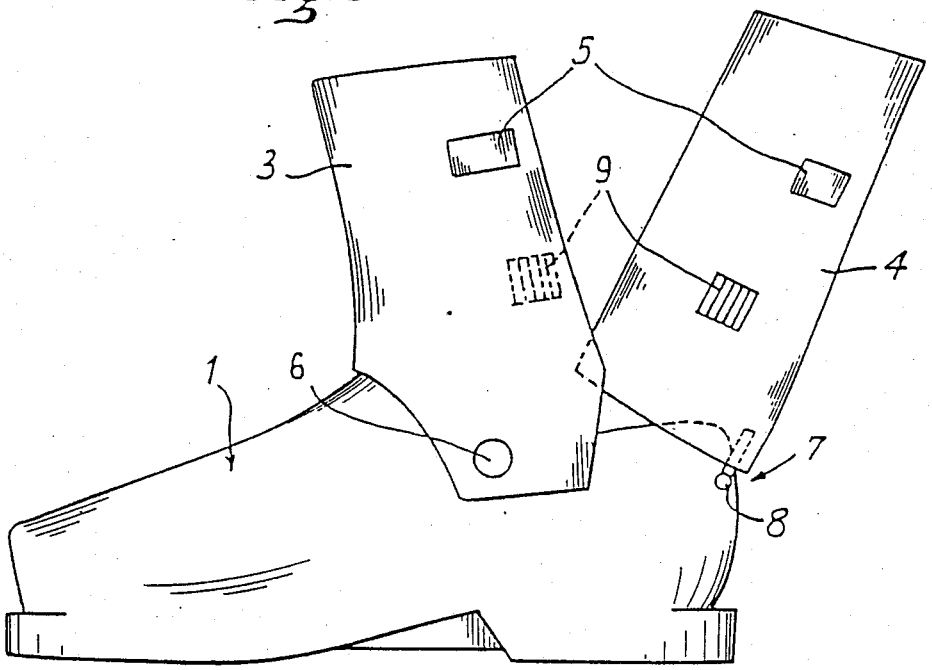
FIG. 3 illustrates an elevational view of the shoe of FIG. 1 in which the upper is shown in an opened position wherein the rear spoiler is pivoted towards the rear to allow insertion of the foot.

The alpine ski boot according to the present invention which is illustrated in FIGS. 1–3, includes a shell base 1 on which is journalled an upper 2 comprising a front cuff 3 and a rear spoiler 4. The front cuff 3 and the rear spoiler 4 are attached to one another, around the lower leg of the skier, in a tightened state when skiing by means of appropriate tightening means 5 which are well known in the art.

The ski boot according to the invention is of the type having two independent journal axes for the front cuff 3 and rear spoiler 4. Front cuff 3 is journalled, at its lower portion on shell base 1, around a front, substantially horizontal and transverse axis which is formed by two substantially coaxial projections 6 affixed on shell base 1. Rear spoiler 4 is connected to the upper, rear portion of shell base 1 by a linkage means 7. In this illustrated embodiment of the invention, this linkage means 7 includes a substantially horizontal and transverse journal axis 8 which is fixedly mounted on the upper, rear portion of shell base 1. Linkage means 7 permit the pivoting of rear spoiler 4 around axis 8 towards the rear of the ski boot for insertion of the foot, and permit the substantially vertical movement of the rear spoiler 4 with respect to shell base 1 when skiing.

Figure 1A:
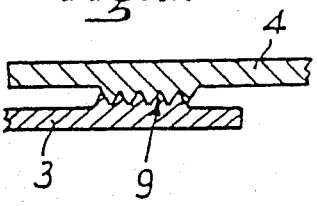
FIG. 1A illustrates a cross-sectional view along A—A of FIG. 1.

Further, in accordance with the present invention latching means are provided on the upper 2. In this embodiment of the latching means, latching means 9 enable the fixing of cuff 3 to spoiler 4 to ensure that upper 2 forms a monoblock assembly when skiing. The latching means 9 is not limited to any one design, but can be formed in a variety of ways. For example, as is shown in FIG. 1A, the latching means 9 can comprise teeth or lugs formed on cuff 3 and spoiler 4 which engage one another while being held together by tightening elements 5.

During skiing, upper 2 is tightened around the lower leg of the skier by tightening means 5 and latching means 9 which affix cuff 3 and spoiler 4 to one another in an integral fashion. In this manner, upper 2 is capable of pivoting as a monoblock assembly when following the forward flexional movements and returning to its initial position. The initial position of upper 2 is indicated schematically in FIGS. 1 and 2 by position X of an axis extending longitudinally through upper 2, while the flexed position towards the front of the ski boot is indicated by position $X_1$ of the axis. As previously discussed, during its frontward flexional movement and its return to the initial position, upper 2 constitutes a monoblock assembly which pivots around the front axis formed by projections 6. This pivoting movement in the form of a monoblock is made possible by virtue of the provision of the rear linkage means 7 between the rear spoiler 4 and shell base 1. In fact, as is shown in FIG. 2, when upper 2 flexes frontwardly, linkage means 7 permits a slight lifting of rear spoiler 4. Consequently, the pivoting movement of the upper 2 in frontward flexion, i.e., in a counterclockwise direction around the front axis formed by projections 6, or in the opposite direction back to the initial position does not translate into any variation in the cross-section of the upper 2 or of the diameter "a" of its entry opening. Consequently, pivoting of upper 2 does not effect the degree of tightening around the lower leg of the skier. This consistency in the degree of tightening is different from known ski boots because in known ski boots, unlike the present invention, the rear spoiler is not linked to the shell base to provide for both pivoting and movement in a substantially vertical direction.

FIG. 3 illustrates the upper 2 being in an open position to allow for the insertion of the foot in the ski boot. In this embodiment, the tightening elements 5 are loosened and the rear spoiler 4 is rotated to the maximum towards the rear to facilitate insertion of the foot into the boot. Accordingly, the linkage means 7, in addition to permitting a slight lifting of rear spoiler 4 when skiing, also acts as a journal permitting the pivoting of spoiler 4 around axis 8.

Figure 4:
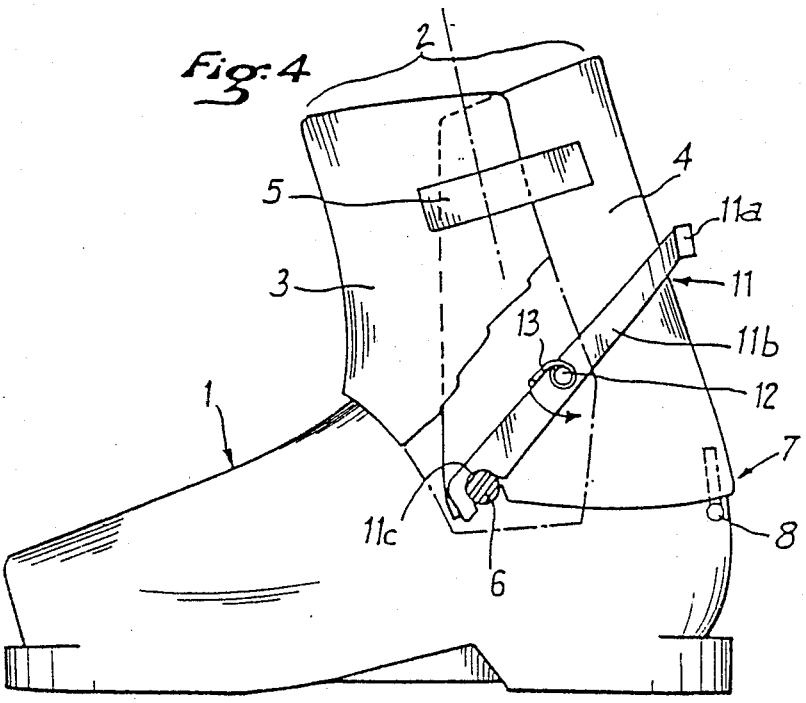
FIG. 4 illustrates an elevational view, with partial break-away, of another embodiment of the ski boot of the present invention provided with a rear support blocking lever, in which the upper is shown tightened around the lower leg in the initial position wherein the upper is not forwardly flexed.
Figure 5:
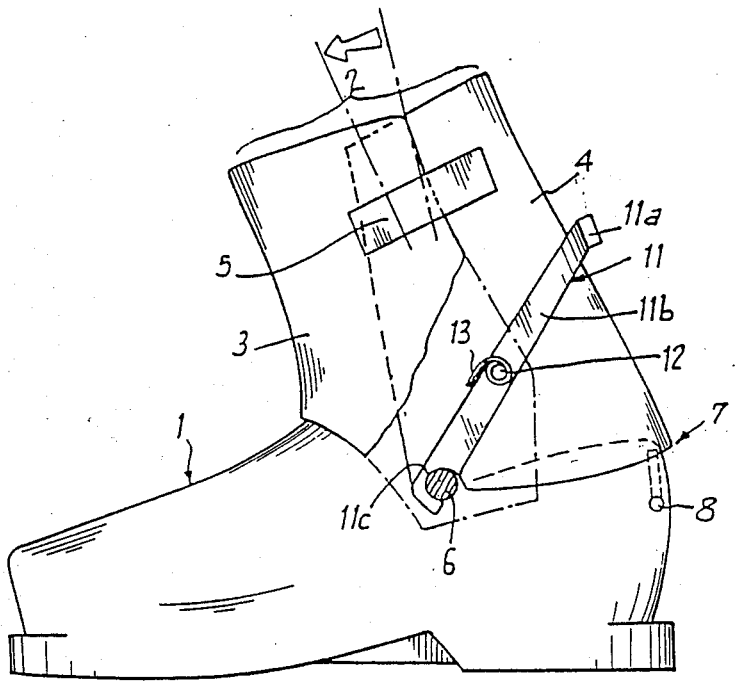
FIG. 5 illustrates an elevational view, with partial break-away, of the shoe of FIG. 4, in which the upper, still tightened around the lower leg, is shown flexed towards the front.
Figure 6:
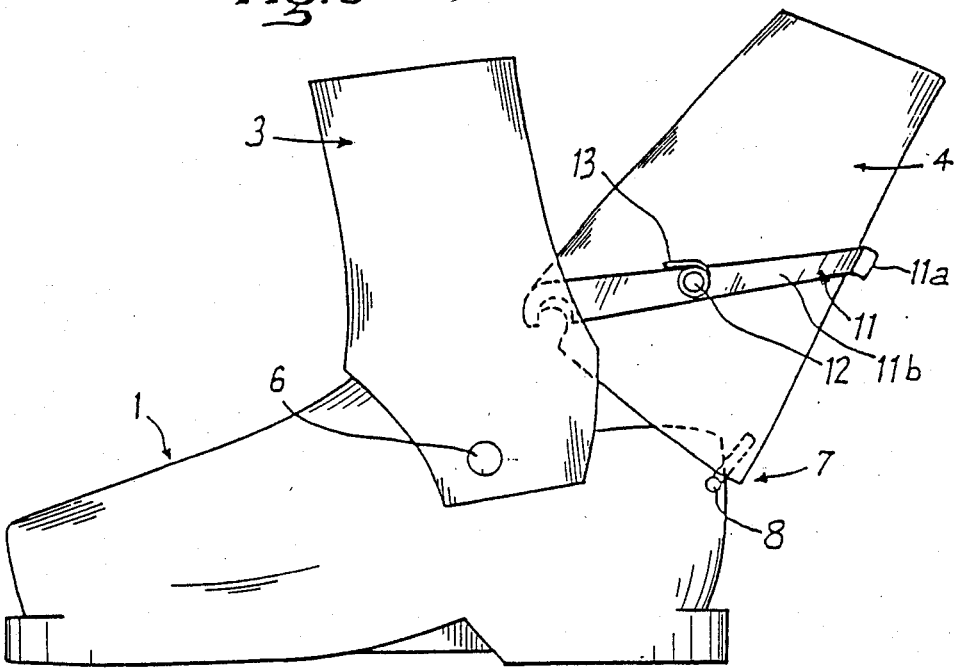
FIG. 6 illustrates an elevational view, with partial break-away, of the shoe of FIG. 4, in which the rear spoiler is shown unlatched and pivoted towards the rear to allow for insertion of the foot.

In another embodiment of the invention illustrated in FIGS. 4–6, the means for latching of rear spoiler 4 to front cuff 3 comprise a rear support blocking lever 11 which is journalled on rear spoiler 4 around a substantially horizontal and transverse axis, formed by two substantially coaxial projections 12 affixed on both sides of rear spoiler 4, positioned above the projections 6 and axis 8. Lever 11, which has the shape of a stirrup, comprises an upper, rear horizontal transverse member **11*a* extending to the rear of rear spoiler 4, and from which extend, frontwardly and downwardly, two inclined lateral arms 11*b* which are journalled on the projections 12. Each of the lateral arms 11*b* ends, at its front, lower end portion, in a hook portion 11*c* which is capable of gripping each of the projections 6 of cuff 3. Each hook portion 11*c* is defined, in the embodiment shown in FIGS. 4–6, by a cut-out provided in the lower edge of the lateral arm 11*b*** so that the corresponding hook is downwardly open.

In FIGS. 4 and 5, the rear blocking support lever 11 is shown in the latched position in which the hook portions **11*c* are engaged on projections 6. In this position, lever 11 affixes cuff 3 to rear spoiler 4 and ensures the pivoting of upper 2 as a monoblock assembly around the transverse axis formed by projections 6. In this embodiment, the boot is opened by loosening the tightening means 5 and pivoting lever 11 in the clockwise direction around the axis formed by projections 12. This pivoting movement is easily obtainable by pressing on the upper, rear transverse member 11*a*. Upon pressing member 11*a*, the hook portions 11*c* disengage from projections 6 so that spoiler 4 can freely pivot towards the rear around axis 8 of linkage means 7**.

Lever 11 can be freely pivotably mounted or, preferably, can be elastically biased. For example, at least one spring means 13 can be wound around at least one of the projections 12. The at least one spring means 13 is mounted so as to pivot lever 11 in the counterclockwise direction to thereby engage hook portions **11*c* against the projections 6. Consequently, when one pivots rear spoiler 4 in the counterclockwise direction around axis 8, to engage it within front cuff 3, the hook portion 11*c* of each lateral arm 11*b* encounters a projection 6 and is pushed downwardly, under the effect of the at least one spring means 13**, to assure latching.

Figure 7:
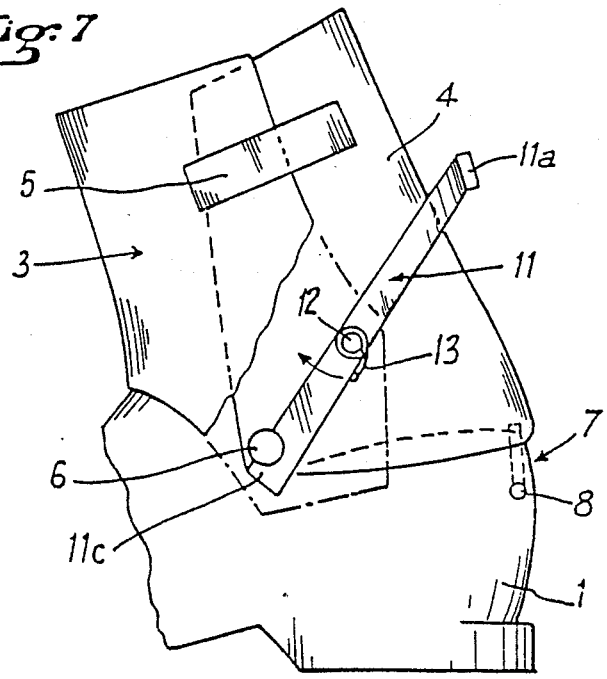
FIG. 7 illustrates a partial elevational view of another embodiment of the rear support blocking lever.

According to a modification of the embodiment illustrated in FIGS. 4–6, each lateral arm **11*b* can have, at its front end, as is shown in FIG. 7, a hook portion 11*c* that is upwardly open, as a result of a cut-out provided in its upper edge. Of course, the action of the at least one spring means 13 would be reversed in this embodiment, with the at least one spring means 13 tending to pivot lever 11** in the clockwise direction.

Figure 8:
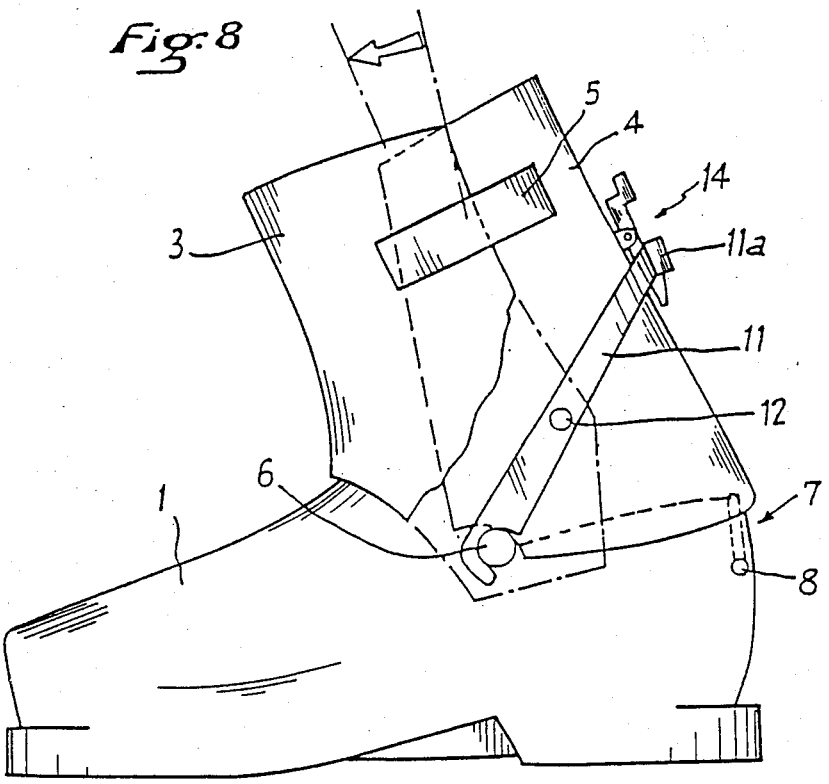
FIG. 8 illustrates an elevational view of another embodiment of the rear support blocking lever.
Figure 9:
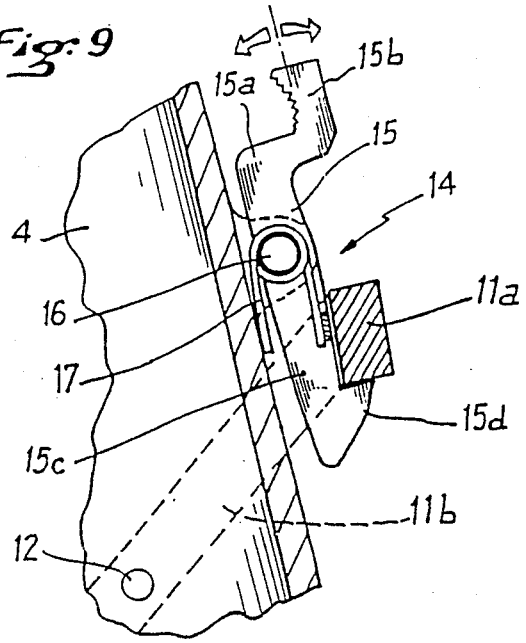
FIG. 9 illustrates a partial vertical and longitudinal cross-sectional view, on a magnified scale, of the retention means of the blocking lever of FIG. 8, in the latching position.

In another embodiment of the invention, as illustrated in FIGS. 8 and 9, the rear blocking support lever 11 is maintained in the latched position by a retention means 14, which is mounted at the rear of rear spoiler 4. This retention means 14 comprises a lever comprising an arm journalled on rear spoiler 4 around a substantially horizontal and transverse axis 16. The arm 15 is biased in the counterclockwise direction by a spring means 17. The arm 15 is composed of an upper arm portion **15*a* which ends, at is upper end, in an activation handle 15*b*, and a lower arm portion 15*c* which ends in the shape of an upwardly directed hook 15*d*. This hook 15*d* is adapted to engage under transverse member 11*a* of rear blocking support lever 11, to maintain the lever in a latched position when skiing. To free lever 11, it suffices to pivot arm 15 in the clockwise direction, by acting on upper activation handle 15***b* to disengage hook 15*d* from transverse member 11*a*. Arm 15 automatically returns to its hooking position under the effect of the spring means 17.

Figure 10:
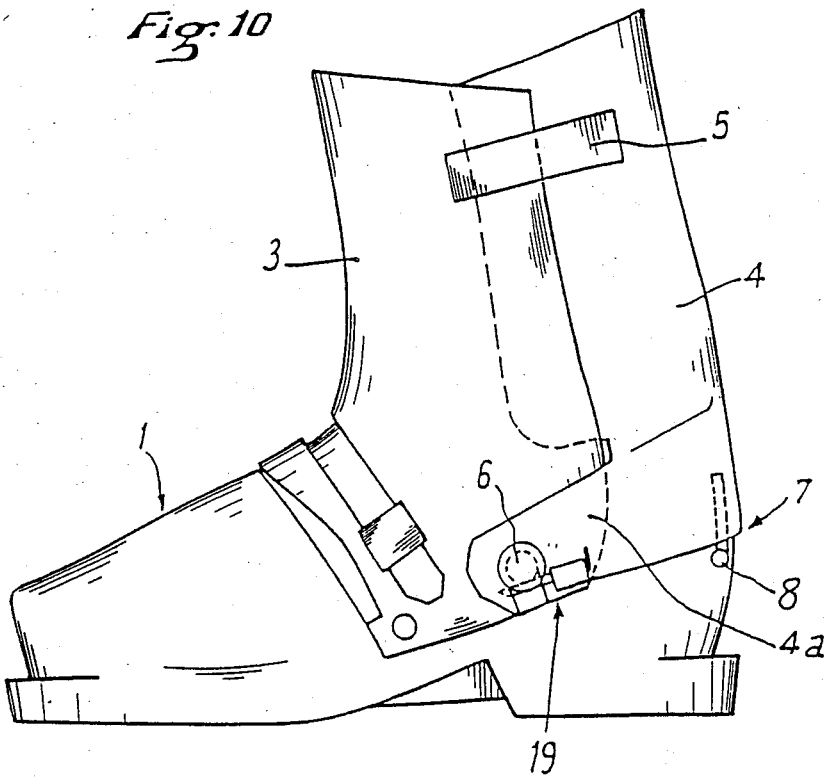
FIG. 10 illustrates an elevational view of another embodiment of the ski boot according to the invention.
Figure 11:
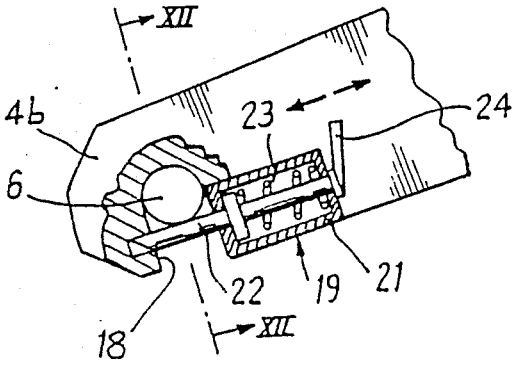
FIG. 11 illustrates an elevational view, partially in vertical cross-section, of the means for locking the rear spoiler on the axis of the front cuff of the ski boot shown in FIG. 10.
Figure 12:
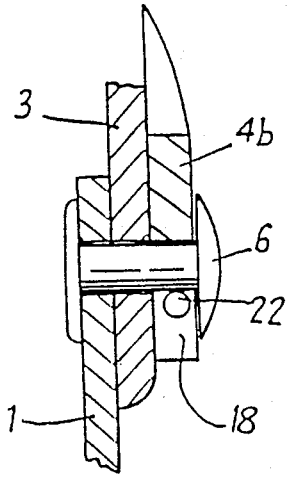
FIG. 12 illustrates a vertical cross-sectional view along line XII—XII of FIG. 11.

In another embodiment of the invention, as illustrated in FIGS. 10–12, the latching means comprise at least one lower flap 4*a* forming a portion of rear spoiler 4 which extends frontwardly and downwardly. This lower flap 4*a* presents, at its front portion, a cut-out 18 opening at its lower edge such that the end portion of flap 4*a* forms a hook portion 4*b* which is downwardly open. This hook portion 4*b* is adapted to engage, in the latching position, on one of the projections 6 forming the journal axis of front cuff 3. The latching means also include a locking means 19 mounted on flap 4*a* which maintains the flap hooked to projection 6 in the latching position. The locking means 19 can comprise a housing means 21 affixed on flap 4*a*, in which is slidably mounted a rod means 22. In the latching position, this rod means protrudes from one side of housing means 21 and extends across cut-out 18, beneath projection 6. Rod means 22 is pushed constantly in this position by a compression spring 23 positioned in housing means 21. Rod means 22 projects towards the exterior, on the other side of housing means 21, and is affixed at this location to an activation handle 24. With activation handle 24, the rod means 22 can be pulled towards the rear, against the action of compression spring 23, so as to retract rod means 22 within housing means 21 to permit release of flap 4*a* from projection 6. Of course, lower flap 4*a* can be on only one side of the rear spoiler 4 or can be on both sides for engagement with each projection 6. Similarly, each lower flap 4*a* can be equipped with locking means 19.

Figure 14:
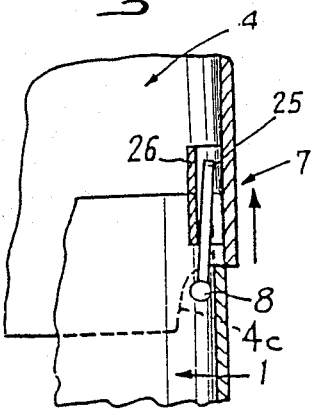
FIG. 14 illustrates a partial vertical and longitudinal cross-sectional view of the means for linking shown in FIG. 13.
Figure 13:
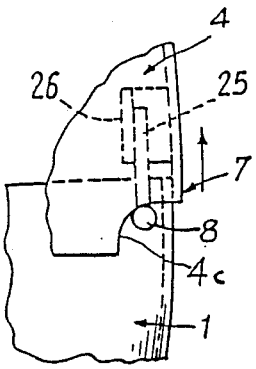
FIG. 13 illustrates a partial elevational view of one embodiment of the means for linking the rear spoiler on the shell base.

FIGS. 13 and 14 illustrate a non-limiting embodiment of the linkage means 7. In this embodiment, axis 8 of linkage means 7 extends substantially horizontally on both sides through the wall of shell base 1 and its ends project to the exterior of shell base 1. Axis 8 is affixed, within shell base 1 and rear spoiler 4, to a radial tongue 25. Radial tongue 25 extends upwardly and is engaged in an internal seat means 26 affixed to the lower, rear portion of spoiler 4. This seat means 26 includes a relatively narrow, hollow inner portion to provide a sliding linkage between spoiler 4 and tongue 25, while allowing axis 8 to constitute the journal axis for the pivoting of spoiler 4 towards the rear. Spoiler 4 has, at its lower, rear edge, cut-outs 4*c* which, in the initial position of upper 2, serve to rigidly support spoiler 4 on the ends of journal axis 8.

Figure 15:
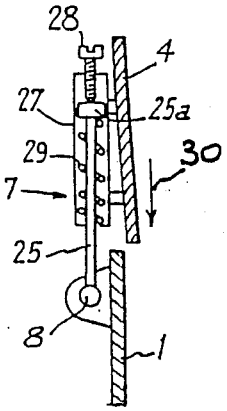
FIG. 15 illustrates a partial vertical and longitudinal cross-sectional view of another embodiment of the means for linking of the rear spoiler on the shell base.

In another embodiment of the invention, as illustrated in FIG. 15, the linkage means 7 are constructed to allow for adjustment of the rear support position of rear spoiler 4 on shell base 1 and to control the pivoting of upper 2. To this end spoiler 4 carries, in its interior, a vertical casing 27 in which is engaged the radial tongue 25 and in the upper portion of which is screwed a support adjustment screw 28. This adjustment screw 28 functions as an adjustable abutment for tongue 25, making it possible, by turning screw 28 in casing 27, to adjust the rear support position of the rear spoiler 4 on shell base 1.

The linkage means 7 can also include elastic means for biasing, in one direction or the other, the rear spoiler 4 with respect to shell base 1. These elastic means can comprise for example, a spring 29 positioned in vertical casing 27 and acting on end 25*a* of tongue 25, which is enlarged to form a support head for spring 29. This spring 29 can be positioned, while being compressed, in vertical casing 27, beneath head 25*a*, to pivot the rear spoiler in the clockwise direction, i.e., in its rear support position, around the transverse axis 6 due to the fact that the compressed spring 29 pushes the rear spoiler 4 in the direction of arrow 30 through the casing 27 which is part of said spoiler; or in the upper compartment of vertical casing 27, above head 25*a*, to bias the rear spoiler 4 in the counterclockwise direction, i.e., towards the front.

Although the invention has been described with reference to particular means, materials and embodiments, it is to be understood that the invention is not limited to the particulars disclosed and extends to all equivalents within the scope of the claims.

I claim:

1. An alpine ski boot comprising an upper journalled on a shell base, the upper comprising two elements adapted to surround the lower leg of a skier, which elements are individually connected to the shell base, the two elements including a front cuff pivotably mounted around a front transverse axis and a rear spoiler; tightening means for tightening the cuff and rear spoiler around the lower leg; and linkage means between the rear spoiler and the shell base adapted to allow a pivoting of the rear spoiler on the shell base around a rear transverse axis, as well as to allow a substantially vertical movement of the rear spoiler with respect to the shell base when skiing, whereby the upper pivots an an entirety around the front transverse axis of the front cuff.

2. The alpine ski boot according to claim 1, wherein the linkage means is adapted to provide free movement between the rear spoiler and the shell base.

3. The alpine ski boot according to claim 1, wherein the linkage means includes an elastic element adapted to bias the rear spoiler with respect to the shell base.

4. The alpine ski boot according to claim 1 including latching means adapted to affix the front cuff to the rear spoiler to ensure that the upper pivots as a monoblock assembly when skiing.

5. The alpine ski boot according to claim 4, wherein the latching means comprise teeth or lugs formed on the front cuff and the rear spoiler, and wherein the teeth or lugs are maintained in an engaged relationship when skiing by the tightening means.

6. The alpine ski boot according to claim 4, wherein the latching means comprise a rear support blocking lever journalled on the rear spoiler around a third transverse axis positioned above the front and rear transverse axes, and wherein the rear support blocking lever comprises, at a front end portion, a portion forming at least one hook which can engage and be latched on at least one projection forming the front transverse axis of the front cuff on the shell base.

7. The alpine ski boot according to claim 6, wherein the rear support blocking lever is in the shape of a stirrup and comprises a rear and upper horizontal transverse member extending towards the rear of the rear spoiler, from which extends, frontwardly and downwardly, two lateral inclined arms which are journalled on projections forming a pivot axis for the rear support blocking lever, and each of the lateral arms ends at a front and lower ended portion in the form of a hook.

8. The alpine ski boot according to claim 7, wherein each portion forming a hook is defined by an opening in the lower edge of the lateral arm so that each hook is opened downwardly.

9. The alpine ski boot according to claim 7, wherein each portion forming a hook is defined by an opening in the upper edge of the lateral arm so that each hook opens upwardly.

10. The alpine ski boot according to claim 6, wherein the rear support blocking lever is biased by at least one spring means which tends to engage the hook shaped portion on the projection forming the front transverse axis of the front cuff.

11. The alpine ski boot according to claim 6, further including a retention means mounted on the rear of rear spoiler to maintain the rear support blocking lever in a latched position when skiing.

12. The alpine ski boot according to claim 11, wherein the retention means comprise a lever having upper and lower arm portions journalled on the rear spoiler around a horizontal and transverse axis and biased by a spring means, the upper arm ends, at its upper end, in an activation handle and the lower arm ends in the shape of an upwardly directed hook adapted to engage the rear support blocking lever to maintain the lever in a latched position when skiing.

13. A ski boot comprising:

a shell base;

an upper including a front cuff and a rear spoiler;

means for tightening the rear spoiler to the front cuff so that the upper can be tightened around the lower leg of a skier;

means pivotally mounting the front cuff on the shell base; and means for mounting the rear spoiler, said means for mounting the rear spoiler being adapted to permit both a pivotal rotation and a substantially vertical movement of the rear spoiler with respect to said rear portion of the shell base, whereby the rear spoiler is capable of rotational movement to a rearward, open position to permit insertion of a foot into the boot, and is capable of a substantially vertical movement, when the rear spoiler is tightened to the front cuff, for pivotal rotation of the tightened upper as a monoblock assembly around the means pivotally mounting the front cuff.

14. The ski boot according to claim 13, further including:

latching means acting in cooperation with the means for tightening to ensure rotation of the front cuff and rear spoiler as a monoblock assembly.

15. The ski boot according to claim 14, wherein:

the latching means comprise teeth or lugs formed on the front cuff and the rear spoiler; and said teeth or lugs are adapted to be maintained in an engaged relationship by the tightening of the front cuff to the rear spoiler effected by the means for tightening.

16. The ski boot according to claim 14, wherein:

the means for pivotally mounting the front cuff comprise two projections mounted on the shell base to form a horizontally horizontal, front transverse axis;

the means for mounting the rear spoiler includes a substantially horizontal, rear transverse axis;

the latching means comprise a rear support blocking lever journalled on a substantially horizontal axis on the rear spoiler, which axis is positioned above the front and rear transverse axes; and the rear support blocking lever includes, at a front portion, at least one hook portion, with each said at least one hook portion being adapted to engage one of said projections.

17. The ski boot according to claim 16, wherein the rear support blocking lever is in the shape of a stirrup and includes:

a rear, upper transverse member extending towards the rear of the rear spoiler;

two frontwardly and downwardly extending laterally inclined arms, which arms are journalled on the axis on the rear spoiler; and each said arm culminates in a front end portion having a hook portion adapted to engage one of said two projections.

18. The ski boot according to claim 17, wherein:

each hook portion comprises a cut-out opening on the front, lower edge of each inclined arm forming a hook portion that is downwardly open.

19. The ski boot according to claim 17, wherein:

each hook portion comprises a cut-out opening on the front, upper edge of each inclined arm forming a hook portion that is upwardly open.

20. The ski boot according to claim 16, wherein:

spring means are included on the substantially horizontal axis on the rear spoiler to bias the rear blocking support lever in a direction to engage each said at least one hook portion with one of said projections.

21. The ski boot according to claim 17, wherein:

spring means are included on the substantially horizontal axis on the rear spoiler to bias the rear blocking support lever in a direction to engage each hook portion with one of said projections.

22. The ski boot according to claim 18, wherein:

spring means are included on the substantially horizontal axis on the rear spoiler to bias the rear blocking support lever in a direction to engage each hook portion with one of said projections.

23. The ski boot according to claim 19, wherein:

spring means are included on the substantially horizontal axis on the rear spoiler to bias the rear blocking support lever in a direction to engage each hook portion with one of said projections.

24. The ski boot according to claim 16, including:

retention means mounted on the rear spoiler for maintaining the rear support blocking lever in a latched position wherein each said at least one hook portion is adapted to engage one of said projections when skiing.

25. The ski boot according to claim 17, including:

retention means mounted on the rear spoiler for maintaining the rear support blocking lever in a latched position wherein each hook portion is adapted to engage one of said projections when skiing.

26. The ski boot according to claim 18, including:

retention means mounted on the rear spoiler for maintaining the rear support blocking lever in a latched position wherein each hook portion is adapted to engage one of said projections when skiing.

27. The ski boot according to claim 20, including:

retention means mounted on the rear spoiler for maintaining the rear support blocking lever in a latched position wherein the each said at least one hook portion is adapted to engage one of said projections when skiing.

28. The ski boot according to claim 21, including:
retention means mounted on the rear spoiler for maintaining the rear support blocking lever in a latched position wherein each hook portion is adapted to engage one of said projections when skiing.

29. The ski boot according to claim 22, including:
retention means mounted on the rear spoiler for maintaining the rear support blocking lever in a latched position wherein each hook portion is adapted to engage one of said projections when skiing.

30. The ski boot according to claim 25, wherein the retention means comprise:
a lever composed of an upper arm portion forming an upper activation handle and a lower arm portion in the shape of a hook;
a substantially horizontal, transverse axis mounted on said rear spoiler, the lever being journalled on said axis at a location between said upper and lower arm portions; and
a spring means adapted to bias the hook of the lower arm portion against the rear, upper transverse member of the rear support blocking lever to maintain the lever in a latched position when skiing.

31. The ski boot according to claim 26, wherein the retention means comprise:
a lever composed of an upper arm portion forming an upper activation handle and a lower arm portion in the shape of a hook;
a substantially horizontal, transverse axis mounted on said rear spoiler, the lever being journalled on this axis at a location between said upper and lower arm portions; and
a spring means adapted to bias the hook of the lower arm portion against the rear, upper transverse member of the rear support blocking lever to maintain the lever in a latched position when skiing.

32. The ski boot according to claim 28, wherein the retention means comprise:
a lever composed of an upper arm portion forming an upper activation handle and a lower arm portion in the shape of a hook;
a substantially horizontal, transverse axis mounted on said rear spoiler, the lever being journalled on this axis at a location between said upper and lower arm portions; and
a spring means adapted to bias the hook of the lower arm portion against the rear, upper transverse member of the rear support blocking lever to maintain the lever in a latched position when skiing.

33. The ski boot according to claim 29, wherein the retention means comprise:
a lever composed of an upper arm portion forming an upper activation handle and a lower arm portion in the shape of a hook;
a substantially horizontal, transverse axis mounted on said rear spoiler, the lever being journalled on this axis at a location between said upper and lower arm portions; and
a spring means adapted to bias the hook of the lower arm portion against the rear, upper transverse member of the rear support blocking lever to maintain the lever in a latched position when skiing.

34. The ski boot according to claim 14, wherein:
the means for pivotally mounting the front cuff comprise two projections mounted on the shell base to form a substantially horizontal, front transverse axis;
the latching means comprise at least one lower flap, each said at least one lower flap being composed of a portion of the rear spoiler which extends frontwardly and downwardly; and
each said at least one lower flap having a hook-shaped portion formed by a cut-out, which hook-shaped portion is shaped to engage one of said projections.

35. The ski boot according to claim 34, further including:
locking means mounted on each said at least one lower flap adapted to maintain each said at least one lower flap in a position engaging the projection.

36. The ski boot according to claim 35, wherein said locking means comprise:
a housing means mounted on the lower flap;
a rod means slideably mounted within the housing means and extending out over the cut-out;
a spring means biasing the rod means over the cut-out; and
an activation handle for retracting the rod means into the housing means to permit removal of the lower flap from a projection.

37. The ski boot according to claim 13, wherein the means for mounting the rear spoiler on a rear portion of the shell base comprise a linkage means comprising:
a substantially horizontal, rear transverse axis mounted on a rear portion of the shell base; a radial tongue affixed to said rear transverse axis; and
seat means affixed to the rear spoiler, which seat means include a relatively narrow, hollow inner portion in which the radial tongue is adapted to slide.

38. The ski boot according to claim 37, wherein:
the linking means further includes means for biasing the rear spoiler.

39. The ski boot according to claim 38, wherein:
the means for biasing the rear spoiler comprises a spring means.

40. The ski boot according to claim 14, wherein the means for mounting the rear spoiler on a rear portion of the shell base comprise a linkage means comprising:
a substantially horizontal, rear transverse axis mounted on a rear portion of the shell base;
a radial tongue affixed to said rear transverse axis; and
seat means affixed to the rear spoiler, which seat means include a relatively narrow, hollow inner portion in which the radial tongue is adapted to slide.

41. The ski boot according to claim 15, wherein the means for mounting the rear spoiler on a rear portion of the shell base comprise a linkage means comprising:
a substantially horizontal, rear transverse axis mounted on a rear portion of the shell base;
a radial tongue affixed to said rear transverse axis; and
seat means affixed to the rear spoiler, which seat means include including a relatively narrow, hollow inner portion in which the radial tongue is adapted to slide.

42. The alpine ski boot as defined by claim 1 wherein said front cuff and rear spoiler are connected to said shell base at separate front and rear axes on said shell base.

43. The ski boot is defined by claim 13 wherein said front cuff and rear spoiler are separately mounted at different locations on the said shell base.

* * * * *

UNITED STATES PATENT AND TRADEMARK OFFICE

CERTIFICATE OF CORRECTION

PATENT NO. : 4,910,888

DATED : March 27, 1990

INVENTOR(S) : Claude PERRISSOUD

It is certified that error appears in the above-identified patent and that said Letters Patent is hereby corrected as shown below:

column 3, line 1, change "ono" to ---on---;
column 8, line 34, change "an an" to ---as an---; and
column 9, line 63, change "horizontally" to --- substantially---.

Signed and Sealed this

Tenth Day of November, 1992

*Attest:*

DOUGLAS B. COMER

*Attesting Officer*

*Acting Commissioner of Patents and Trademarks*